United States Patent [19]

Fleischer

[11] 4,190,765

[45] Feb. 26, 1980

[54] COUNTER OPERATING SYSTEM

[75] Inventor: Donald W. Fleischer, Wethersfield, Conn.

[73] Assignee: Veeder Industries Inc., Hartford, Conn.

[21] Appl. No.: 910,688

[22] Filed: May 30, 1978

Related U.S. Application Data

[60] Division of Ser. No. 832,553, Sep. 12, 1977, Pat. No. 4,127,767, which is a continuation-in-part of Ser. No. 772,943, Feb. 28, 1977, Pat. No. 4,132,887.

[51] Int. Cl.[2] ..... G06M 1/04

[52] U.S. Cl. ..... 235/92 C; 235/92 FL;

[58] Field of Search ..... 235/92 C, 92 FL, 92 CC, 235/92 FP, 92 K, 92 A; 318/696

[56] References Cited

U.S. PATENT DOCUMENTS

| | | | |
|---|---|---|---|
| 3,374,410 | 3/1968 | Cronquist et al. | 310/49 R |
| 3,805,138 | 4/1974 | Hilker | 318/696 |
| 3,809,990 | 5/1974 | Kuo et al. | 310/49 R |
| 3,908,195 | 9/1975 | Leenhouts | 318/696 |
| 4,075,544 | 2/1978 | Leenhouts | 318/696 |

*Primary Examiner*—Joseph M. Thesz

*Attorney, Agent, or Firm*—Prutzman, Kalb, Chilton & Alix

[57] ABSTRACT

Embodiments of a fuel pump register and register drive unit assembly having a register with pairs of oppositely facing volume and cost counters, conventional reset means for resetting the counter wheels to zero between fluid deliveries, the volume counters being mechanically indexed in a conventional manner for registering the volume amount of fuel delivered, and the cost counters being indexed by a pair of electrical stepping motors with one stepping motor connected for indexing the lowest order counter wheels of both cost counters and the second stepping motor connected for indexing the second lowest order cost counter wheels of both cost counters, the remaining higher order counter wheels of both cost counters being indexed via transfer pinions in a conventional manner.

5 Claims, 13 Drawing Figures

COUNTER OPERATING SYSTEM

RELATED APPLICATION

This is a division, of application Ser. No. 832,553, filed Sept. 12, 1977, now U.S. Pat. No. 4,127,767; and which in turn is a continuation-in-part of my application Ser. No. 772,943, filed Feb. 28, 1977, and entitled "Counting System", now U.S. Pat. No. 4,132,887.

BACKGROUND AND SUMMARY OF THE INVENTION

The present invention relates to a new and improved counter operating systems having notable utility in register and register drive unit assemblies of the type employed in fuel dispensing apparatus for registering the volume and cost amounts of fuel delivered and, for example, utility in the factory modification and/or field or factory conversion of existing fuel pump/register and register drive unit assemblies of the type having a register generally as shown and described in U.S. Pat. No. 2,814,444 of Harvey N. Bliss dated Nov. 26, 1957 and entitled "Register".

The conventional mechanical fuel pump register of the type shown and described in U.S. Pat. No. 2,814,444 has upper and lower resettable cost and volume counters on each of two opposite sides of the register for registering the cost and volume amounts of the fuel delivered. The register is conventionally employed in an assembly with a mechanical variator (for example, of the type disclosed in U.S. Pat. No. 3,314,867 of Richard B. Hamlin dated Dec. 3, 1968 and entitled "Variator") operable for establishing and posting the desired unit volume price of fuel. The usual variator is connected for being driven by a fuel meter and for driving the volume and cost counters of the register for registering the volume amount of fuel delivered (e.g., in gallons) and the cost amount of fuel delivered in accordance with the volume amount of fuel delivered and the established unit volume price.

The mechanical cost counter drive train is rotated at a rate proportional to the established unit volume price and the volumetric rate of delivery and, therefore, for any given maximum volumetric rate of delivery, its maximum rate of rotation increases proportionally with the unit volume price of gasoline. Since the price of gasoline is escalating and is likely to continue to escalate, the cost counter drive train is and will continue to be rotated at correspondingly increasing rates. The resulting higher rotational speed decreases the life and increases the operating noise of the mechanical cost counter and its drive train. The higher rotational speed also increases the required drive torque of the meter conventionally transmitted through the variator to the cost counters and therefore decreases the useful life of the mechanical system and the accuracy of the meter.

It is therefore a principal aim of the present invention to provide a new and improved counter operating system for a conventional fuel pump register for converting and/or modifying the usual register operating system for increasing the useful life of the register and the reliability of its associated meter.

It is another aim of the present invention to provide new and improved register drive system conversion means which permits conversion of the mechanical drive systems of existing mechanical registers with minimum inconvenience and downtime.

It is another aim of the present invention to provide a modified fuel pump register drive system which substantially reduces the drive torque required for operating the cost counters and thereby substantially increases the operating life of the cost counters and the meter associated with the fuel pump register.

It is a further aim of the present invention to provide a new and improved gasoline pump register operating system having an improved resettable cost counter.

It is another aim of the present invention to provide new and improved register operating system means useful in modifying the cost and/or volume counter drive system of conventional fuel pumps.

It is a further aim of the present invention to provide a new and improved fuel pump register and register drive unit assembly which is substantially the same size as existing fuel pump register and register drive unit assemblies and such that the improved assembly can be readily substituted for an existing assembly and without further modification of the fuel pump.

It is another aim of the present invention to provide in a counter system of the type employing a bank of a plurality of coaxial counter wheels a new and improved wheel indexing system for indexing the bank of counter wheels.

It is a still further aim of the present invention to provide in a counter system of the type having an electrical pulse generator adapted to be driven for generating a pulse train with a pulse for each predetermined drive increment and a bank of a plurality of coaxial counter wheels of increasing order for displaying an accumulated count in accordance with the number of generated pulses, a new and improved counter wheel indexing system operable by the train of electrical pulses for indexing the bank of counter wheels for displaying an accumulated count in accordance with the number of generated pulses.

It is a further aim of the present invention to provide new and improved means for modifying the conventional fuel pump register operating system for expanding its unit volume price range. In accordance with the present invention, the unit volume price of the conventional fuel pump can be extended beyond the conventional maximum \$0.99-9/10 unit volume price without requiring additional drive torque from the associated fuel meter and without diminishing the operational life of the cost counter wheels of the fuel pump register.

It is another aim of the present invention to provide a new and improved register operating system for a conventional fuel pump register for converting and/or modifying the register operating system for extending the available price range from the conventional price range of \$0.000 to \$0.999 per gallon to an expanded price range of \$0.000 to \$9.999 per gallon.

It is a further aim of the present invention to provide a new and improved cost counting system for a conventional fuel pump register which employs conventional cost counter wheels mechanically resettable in a conventional manner and which employs a new and improved cost counter wheel drive system which provides for substantially reducing the required cost counter drive torque and increasing the useful life of the cost counter wheels and their drive train.

It is another aim of the present invention to provide a new and improved counter indexing system for a resettable fuel pump register for automatically removing any initial counter readout error which occurs when the register is reset.

It is a further aim of the present invention to provide a new and improved counting system for a conventional fuel pump register useful in fuel pump installations, such as self-service installations, having a remote readout of the amount of fuel delivered, and which provides a remote readout which correctly corresponds to the register readout at the fuel delivery pump.

It is a further aim of the present invention to provide in a counting system of the type having a bank of a plurality of coaxial counter wheels of increasing order of significance, a new and improved wheel indexing system for indexing the bank of counter wheels for registering a count. Also, in accordance with one embodiment of the present invention, the wheel indexing system provides a one-hundred increment lowest order wheel, for example, for registering a count from 0 to 99, and a new and improved indexing system for indexing the second order counter wheel therewith in a manner avoiding any readout ambiguity during count transfers from the lowest to the second order counter wheels.

It is a further aim of the present invention to provide a new and improved cost counter operating system for a conventional fuel pump register for converting and/or modifying the register to eliminate the usual mechanical variator.

It is another aim of the present invention to provide in a fuel pump register cost counter operating system, a new and improved hybrid association of mechanical and electrical components for substantially extending the useful life of the register, reducing the required drive torque of the associated fuel pump meter and extending the available unit volume price range of the fuel pump.

It is a further aim of the present invention to provide a new and improved cost counter operating system for a conventional fuel pump register useful in the modification and/or conversion of multiple grade fuel pumps, such as blending pumps, operable for selectively dispensing each of a plurality of different fuel grades or products.

Other objects will be in part obvious and in part pointed out more in detail hereinafter.

A better understanding of the invention will be obtained from the following detailed description and the accompanying drawings of illustrative applications of the invention.

DESCRIPTION OF THE PREFERRED EMBODIMENTS

Figure 1:
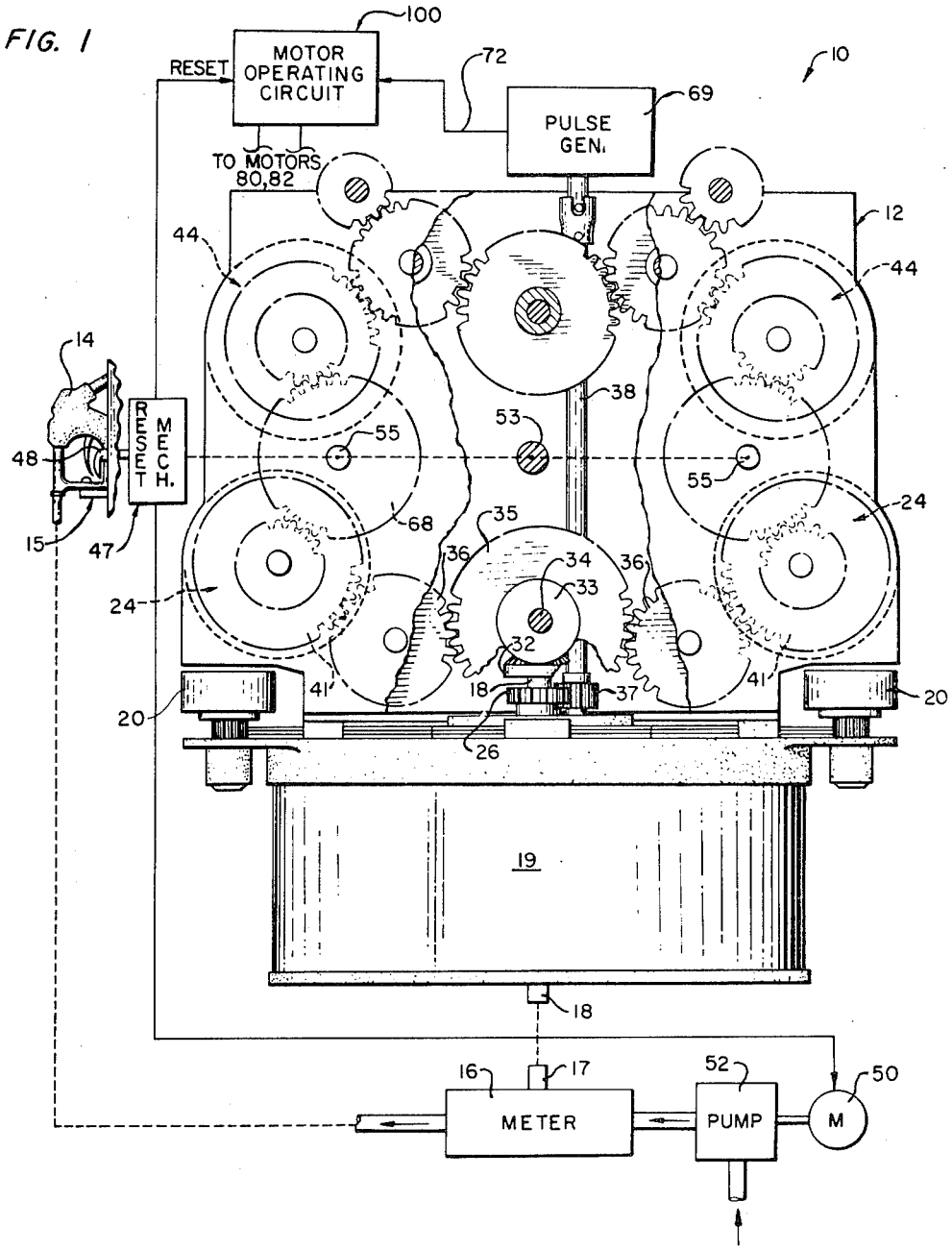
FIG. 1 is a partly diagrammatic side elevation view, partly broken away and partly in section, of a gasoline dispensing pump having a fuel pump register incorporating a first embodiment of a counter operating system of the present invention.

Referring now to the drawings in detail wherein like reference numerals indicate like parts throughout the several figures and referring in particular to FIGS. 1–5, a gasoline delivery pump 10 employing a resettable register 12 incorporating a first embodiment of a counter operating system of the present invention is shown having a nozzle 14 for delivering fuel and a suitable nozzle storage receptacle 15 for storing the nozzle 14 between fuel deliveries. In a conventional manner, a meter 16 provided in the fuel delivery conduit has a rotary output shaft 17 driven in accordance with the volume amount of fuel delivered. The meter shaft 17 is suitably coupled to an input or center shaft 18 of a variator 19 of the type described in the aforementioned U.S. Pat. No. 3,413,867. Briefly, the variator comprises three settable range arms (not shown) of ascending order of significance which can be individually manually set into engagement with selected gear steps of a cone gear (not shown) to collectively establish the desired unit volume price of fuel within a three-place unit volume price range. The variator also comprises two sets of three price-posting wheels 20 at opposite ends of the variator for displaying the established unit volume price. The three price wheels 20 of each set are mechanically connected to the respective range arms for posting the three-place unit volume price established by the range arm settings.

The variator center shaft 18 extends through the variator and is mechanically connected (via bevel gears 32, 33, a horizontal volume shaft 34, shaft and idler gears 35, 36, and lowest order wheel drive gears 41) for driving a pair of oppositely facing parallel volume counters 24 of the register 12 located directly above the variator price wheels 20. Thus, the two volume counters 24 are directly mechanically driven by the meter 16 via the variator center shaft 18 for registering the volume amount of fuel delivered.

A rotary output gear 26 of the variator rotatably mounted on the variator center shaft 18 is driven by the meter 16 via the variator cone gear and variator range arms in accordance with the established unit volume price. The variator output gear 26 is mechanically connected via a gear 37 for driving a vertical cost shaft 38 of the register. The vertical cost shaft 38 in conventional registers of the type disclosed in the aforementioned U.S. Pat. No. 2,814,444 is mechanically connected for driving a pair of oppositely facing parallel cost counters 44 located directly above the volume counters 24 for registering the cost amount of fuel dispensed in accordance with the volume amount dispensed and the unit volume price established by the variator setting. However, in accordance with the embodiment of the present invention shown in FIGS. 1 and 2, the conventional mechanical drive connecting the vertical cost shaft 38 to the cost counters 44 is removed in the case of a conversion, or is not employed in the case of an original construction of a modified register. Also, in each case a longer vertical cost shaft 38 is preferably provided in place of the usual vertical cost shaft (not shown) for driving a pulse generator 69 described more fully hereinafter. The presettable register 12 has a suitable conventional manual or motor driven mechanical reset mechanism 47 (shown diagrammatically in FIG. 1) operable by a register control handle 48. The register control handle 48 is positioned adjacent the nozzle storage receptacle 15 so that the handle 48 has to be rotated to its vertical or "off" position to permit the nozzle 14 to be placed in its storage receptacle at the completion of a fuel delivery, and so that the nozzle 14 has to be removed from its storage receptacle 15 to permit the handle 48 to be rotated to its horizontal or "on" position. Rotation of the handle 48 to its vertical or "off" position provides for de-energizing a pump drive motor 50 for a gasoline delivery pump 52 and for conditioning the register 12 for being reset, and rotation of the handle 48 to its horizontal or "on" position provides for operating the reset mechanism 47 for selectively rotating a center reset control shaft 53 and two wheel reset shafts 55 (FIG. 1) and thereby mechanically reset the volume and cost counter wheels to zero and then recondition the volume and cost counters 24, 44 for registering the volume and cost of the succeeding fuel delivery. Also, the register reset mechanism 47 is connected for re-energizing the pump motor 50 after the volume and cost counters 24 have been reset and the register 12 is conditioned for registering the subsequent delivery.

The cost counters 44 are preferably conventional cost counters excepting that the usual transfer pinion 54 located between the lowest order or right hand decade wheel 56 and the second decade wheel 57 (of the bank of four decade counter wheels 56–59 of increasing order of significance of each cost counter 44) is replaced by a separate indexing system (hereinafter described) employed for indexing the bank of three highest order counter wheels 57–59. Also, where a register of the type disclosed in the aforementioned U.S. Pat. No. 2,814,444 is employed, preferably the conventional second decade wheels are replaced by standard lowest order decade wheels (like the wheels 56 and for example of the type shown in U.S. Pat. No. 2,814,444) having (a) a forty-tooth metal drive gear 62 (instead of the usual twenty-tooth plastic drive gear 64 as provided on the remaining higher order counter wheels 58, 59) and (b) a two-hundred-fifty position drive clutch (not shown) between its drive gear 62 and indicator wheel 66 (instead of the usual twenty-position drive clutch as provided on the remaining higher order counter wheels 58, 59). In other words, preferably a standard right hand wheel like the lowest order wheel 56 is also used as the second order wheel 57. The remaining higher order counter wheels 58 and 59 are not replaced or modified and, for example, may be conventional wheels of the type shown in U.S. Pat. No. 3,223,316 of L. E. Coulter et al dated Dec. 14, 1965 and entitled "Counter Wheel Assembly".

The four cost wheels 56–59 of each cost counter 44 therefore have a generally conventional construction and are adapted to be mechanically reset to zero between fuel deliveries in a conventional manner by axially shifting their support shafts 67 and by rotating the wheel reset gears 68 (FIG. 1) via intermittent gearing (not shown) as described in U.S. Pat. No. 2,814,444. Accordingly, the four parallel volume and cost counters 24,44 are mechanically reset together in a conventional manner, either manually generally as disclosed in U.S. Pat. No. 2,814,444 or by an electric motor-driven reset mechanism, for example as disclosed in U.S. Pat. No. 3,216,659 of E. C. Ambler et al dated Nov. 9, 1965 and entitled "Resetting Control Mechanism for Counting Device".

A rotary electrical pulse generator 69, for example, a rotary pulse generator of the type described in U.S. Pat. No. 3,786,272 of John G. Gamble et al dated Jan. 15, 1974 and entitled "Hall Effect Rotary Pulse Generator" is shown mounted above the register 12 in alignment with the vertical cost shaft 38 for being directly driven by the shaft 38. The pulse generator 69 has a suitable explosion-proof housing and is driven for generating a train of electrical cost pulses in its output 72 with a cost pulse for each predetermined angular increment of rotation of the vertical cost shaft 38 and therefore for each predetermined incremental cost amount of fuel delivered. In the shown embodiment, the pulse generator 69 is driven to provide two hundred equally spaced cost pulses for each revolution of the lowest order cost wheel 56, and therefore where the cost wheel 56 is a conventional "cents" decade wheel as shown in FIG. 2, two hundred pulses for each ten cents (or twenty pulses for each one cent) of fuel delivered.

Figure 2:
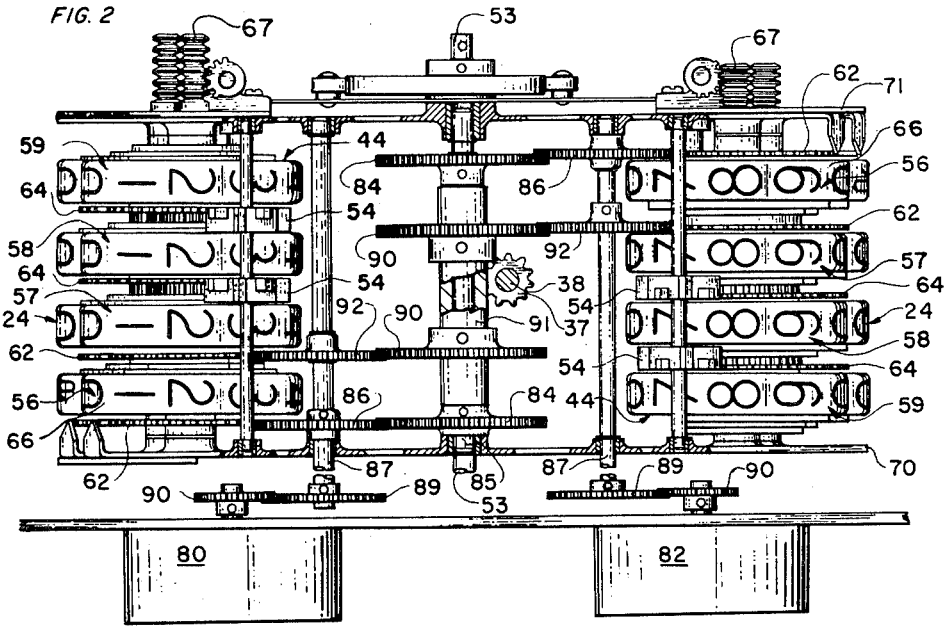
FIG. 2 is a partial top plan view, partly broken away and partly in section, of the fuel pump register of FIG. 1, primarily showing a cost counter indexing mechanism of the register.

Referring to FIG. 2, the lowest order cost wheels 56 of the oppositely facing cost counters 44 are mechanically connected to be indexed together, each in the additive direction, by a rotary stepping motor 80. Similarly, the second order cost wheels 57 of the two cost counters 44 are mechanically connected to be indexed together, each in the additive direction, by a second rotary stepping motor 82. For that purpose, the drive gears 62 of the lowest order cost wheels 56 are interconnected via axially spaced gears 84 secured onto the usual horizontal cost center shaft 85 and via intermediate gears 86 in the conventional manner. The usual fixed stub shafts (not shown) conventionally used for supporting the intermediate gears 86 are replaced by elongated drive shafts 87 rotatably mounted within suitable bushings inserted into aligned bores in the register side plates 70, 71. The two drive shafts 87 are mounted to extend through one of the register side plates 70 to be driven via suitable gears 89,90 by the two stepping motors 80, 82. One of the intermediate gears 86 is secured to its support shaft 87 to connect the stepping motor 80 for indexing the lowest order wheels 56 whereas the other intermediate gear 86 is rotatably mounted on the other support shaft 87.

Similarly, the drive gears 62 of the second order wheels 57 are interconnected via suitable axially spaced gears 90 secured onto a drive sleeve 91 (rotatably mounted on the center shaft 85) and intermediate gears 92 mounted on the drive shafts 87. One of the intermediate gears 92 is secured to its support shaft 87 for connecting the second order wheels 57 for being indexed by the second stepping motor 82.

The electrical stepping motors 80, 82 are suitably mounted at the side of the register 12 and have suitable explosion-proof housings.

In the shown embodiment, each stepping motor 80, 82 has a repeating four-phase stepping cycle with four equiangularly spaced (i.e. 7½° spaced) steps established by its four stepping coils 95 (FIG. 5) and therefore a total of forty-eight steps for each motor revolution. Also, each stepping motor 80, 82 is connected so that each respective pair of decade wheels 56, 57 is indexed twelve steps for each count or 36° of rotation of the decade wheels and whereby each stepping motor 80, 82 is operated through three complete four-step operating cycles for indexing the respective pair of counter wheels 56, 57 one count. Also, therefore, each stepping motor 80, 82 starts each count cycle at the same initial phase.

Figure 3A:
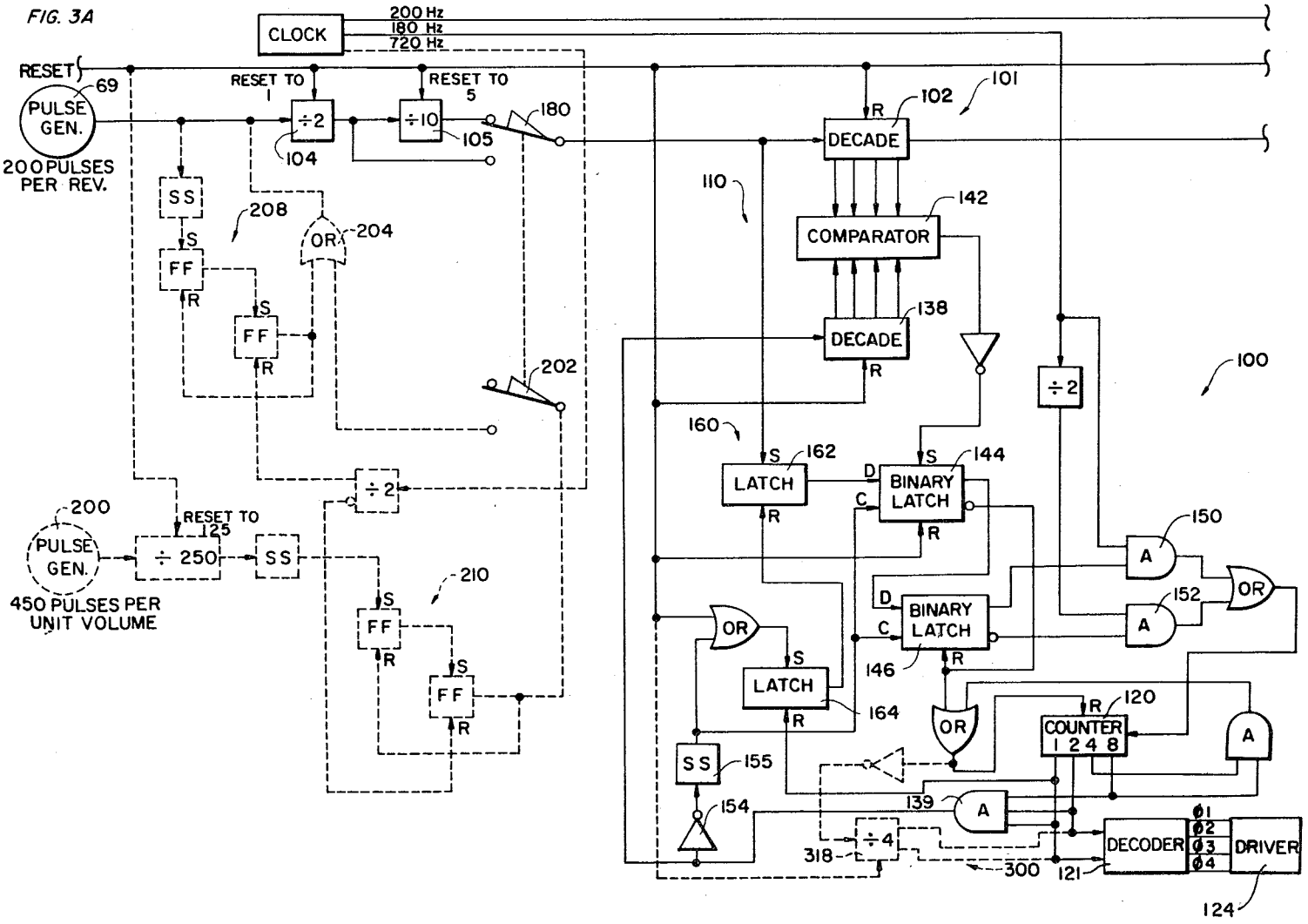
FIGS. 3A and 3B collectively are a generally schematic illustration, partly broken away, showing in full lines an embodiment of a motor operating circuit of the embodiment of the counter operating system of FIG. 1, and additionally showing modifications thereof in broken lines.
Figure 3B:
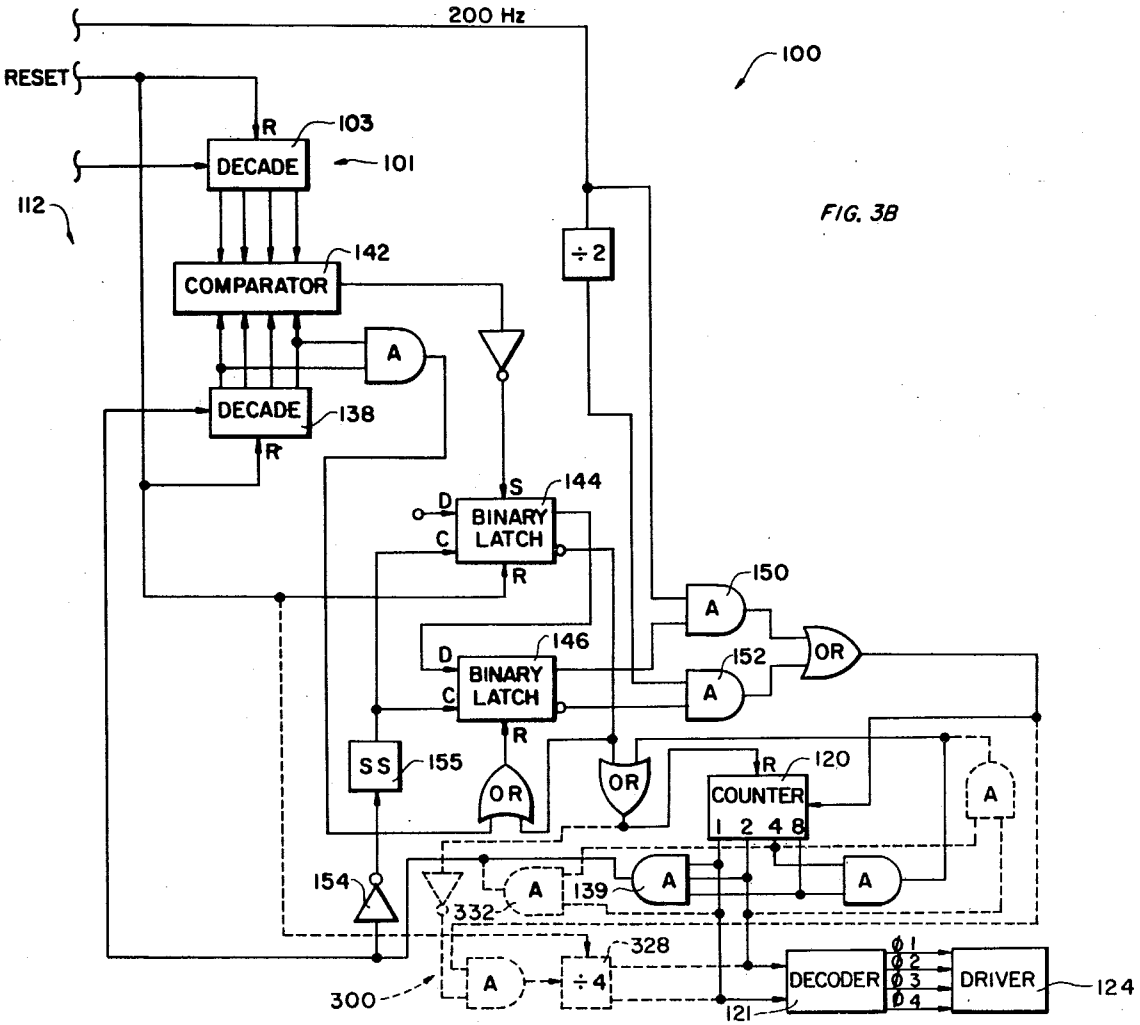

A functional stepping motor operating circuit 100, shown in full lines in FIGS. 3A and 3B and preferably principally provided by a suitable microprocessor, is employed for operating the stepping motors 80, 82 in accordance with the number of pulses generated by the pulse generator 69 for registering the cost amount of fuel delivered in accordance with the volume amount of fuel delivered and the unit volume price established by the variator setting.

The motor operating circuit 100 comprises a master storage counter 101 with two BCD master decades or counters 102, 103 of ascending order of significance for the stepping motors 80, 82 for the first and second decade wheels 56, 57 respectively.

The cost pulse generator 69 is connected via divide-by-two and divide-by-ten input counters 104, 105 respectively, to the lower order BCD decade 102, and in a conventional manner the lower order BCD decade 102 is connected to transmit a carry or transfer pulse to the higher order decade 103 for each ten input pulses to the lower order decade 102. The motor operating circuit 100, including the master storage counter 101 and the input counters 104, 105 are suitably connected to the register reset mechanism 47 to be reset between fluid deliveries when the volume and cost counters 24, 44 are reset and, for example, when the pump control handle 48 is turned to its "on" position or when the pump motor 50 is energized (but in any event to ensure that the motor operating circuit 100 is fully reset before the commencement of each delivery of fuel).

The pulse generator 69 is not reset in the described embodiment when the register 12 is reset (although, if desired, suitable mechanical means could be provided in the reset mechanism 47 for resetting the pulse generator 69 with the volume and cost counters 24, 44). Therefore, the input counters 104, 105 are preferably reset so that each one-cent cost pulse transmitted to the master storage counter 101 is timed to occur approximately when half of that cost increment of fuel is delivered.

During each fuel delivery, the BCD storage decades 102, 103 are stepped by the cost pulse generator 69 to accurately accumulate the first two decimal places of the cost amount of fuel delivered, it being seen that the lowest order BCD decade 102 is indexed one count for each twenty pulses from the pulse generator 69 and therefore one count for each one-cent cost amount of fuel delivered.

The motor operating circuit 100 employs separate slave circuits 110, 112 for indexing the stepping motors 80, 82 in accordance with the decade counts of the respective master decades 102, 103 respectively. Each slave circuit 110, 112 provides for operating the respective stepping motor 80, 82 through three, four step-cycles (i.e. twelve steps) for each count or 36° rotation of the wheels 56, 57. The first stage slave circuit 110 provides for indexing the lowest order wheels 56 at a maximum rate of fifteen counts per second. Thus, if the master BCD decade 102 is indexed at a rate greater than fifteen counts per second, the wheels 56 will be indexed at their maximum rate, a rate at which they are visually unreadable. If the master decade 102 is indexed at a lesser rate, the wheels 56 will be indexed to closely track the master decade 102.

The second-stage slave circuit 112 provides for indexing the second counter wheels 57 to generally continuously track the count of the second-stage master decade 103 (at a maximum counting rate of 16⅔ counts per second, excepting that the counter wheels 57 are indexed at one-half that rate during count transfers as the counter wheels 57 are indexed from "9" to "0"). Thus, as the second master decade 103 is indexed at one-tenth the rate of the first master decade 102, the maximum available average stepping rate (of about fifteen counts per second) is established to ensure that the second wheels 57 are indexed to generally continuously track the cost count of the second decade 103.

In each slave circuit 110, 112, a binary counter 120 is connected to be indexed through a twelve-step cycle for stepping the respective four-phase motor 80, 82 twelve steps (i.e., three full four-phase cycles) for indexing the respective counter wheels 56, 57 one full count. More particularly, each stepping counter 120 is connected via a suitable decoder 121 and a motor drive circuit 124 (shown schematically in FIG. 5) to step the respective motor 80, 82. And, the four coils 95 of each stepping motor 80, 82 are energized in sequence through three, four-phase cycles to index the respective counter wheels 56, 57 one count or 36° each time the stepping counter 120 is cycled.

Figure 5:
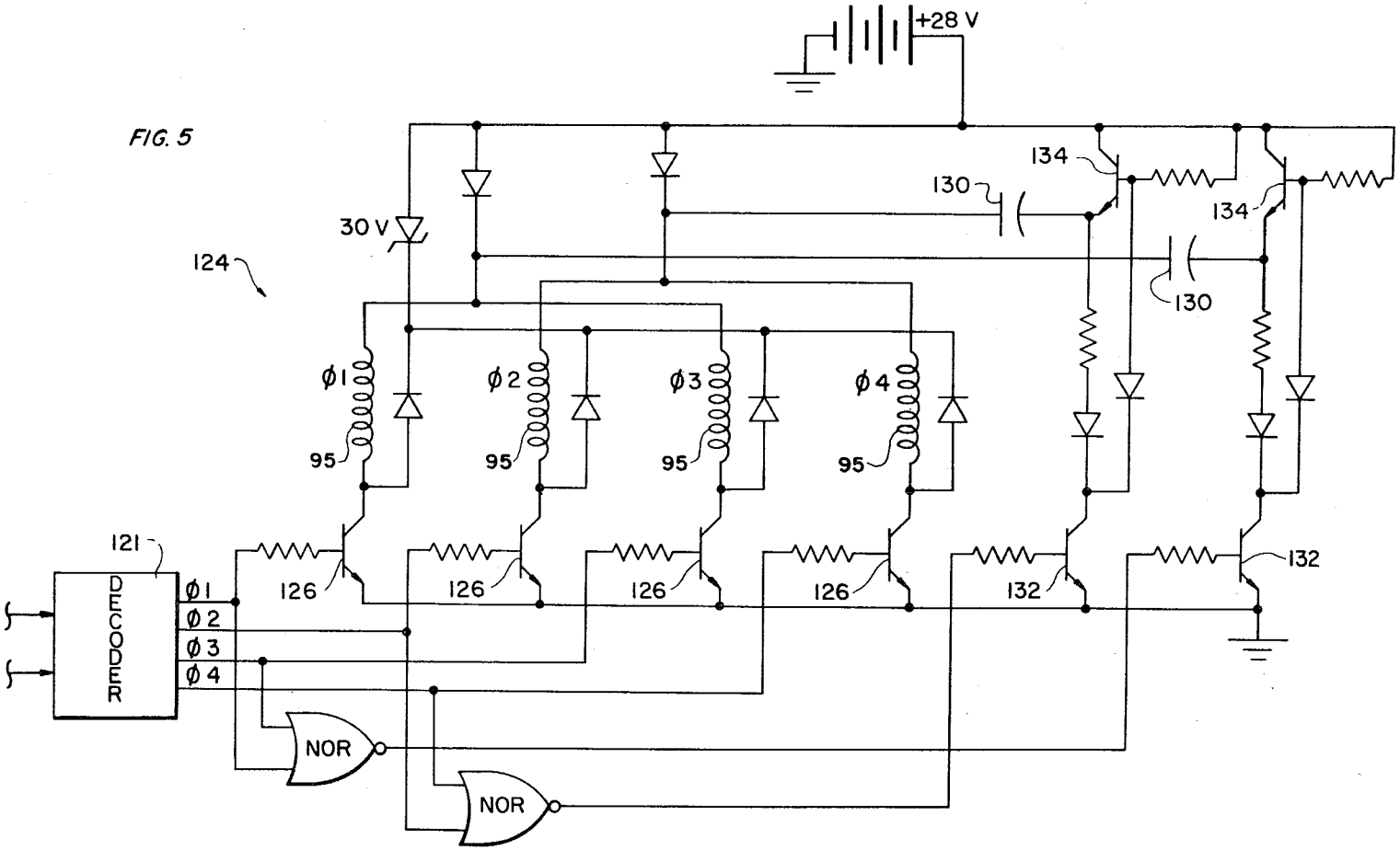
FIG. 5 is a schematic illustration, partly broken away, showing a motor drive circuit of the counter operating system.
Figure 6:
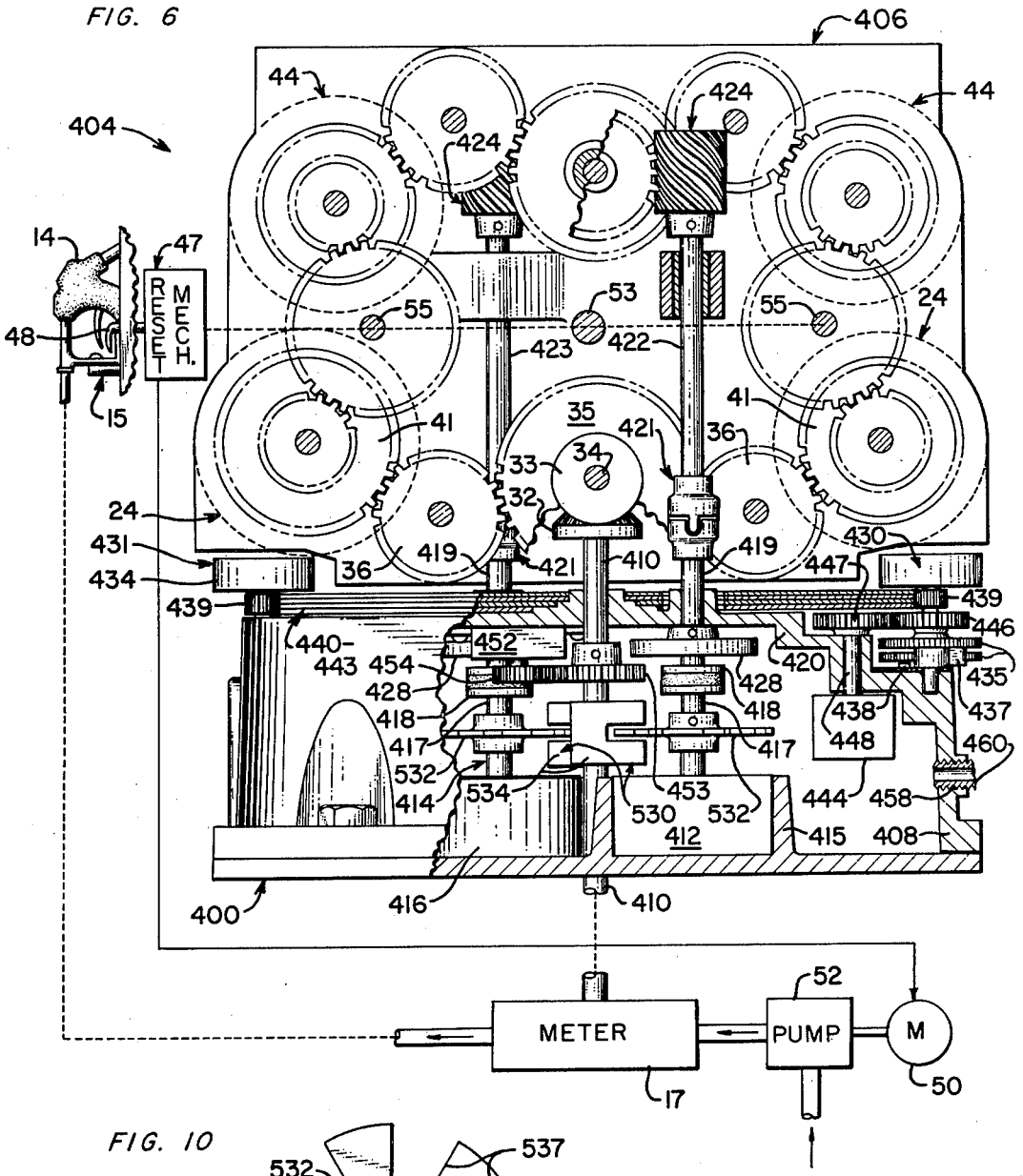
FIG. 6 is a partly diagrammatic side elevation view, partly broken away and partly in section, of a gasoline dispensing pump incorporating a second embodiment of a counter operating system of the present invention.

Referring to FIG. 5, each motor drive circuit 124 comprises a suitable Darlington switching transistor 126 for controlling the operation of each motor stepping coil 95 and a pair of suitable capacitors 130 connected for increasing the rate of coil energization (and thereby increase the motor stepping rate). And with the capacitor circuit provided, it has been found that the desired motor stepping rate can be obtained with a relatively low 28 volt power supply as shown. Each capacitor 130 is connected to be charged during alternate motor operating phases by connecting the capacitor 130 to ground via a switching transistor 132. When each stepping coil 95 is energized, the low or ground potential lead of the respective capacitor 130 is connected to the 28 volt power supply via a switching transistor 134 to momentarily increase the applied voltage to the stepping coil 95, initially to approximately 56 volts, thereby substantially increasing the rate of energization of the coil 95.

Referring to FIGS. 3A and 3B, the first and second stage slave circuits 110, 112 employ slave decades 138 which are connected via AND gates 139 to be indexed at the eleventh step of each twelve-step count cycle of the counter 120. The count of each slave decade 138 therefore remains substantially in synchronism with the respective decade counter wheels 56, 57. A comparator 142 in each slave circuit 110, 112 is connected to the respective master decade 102, 103 and slave decade 138 to selectively cycle the stepping counters 120 and thereby index the respective counter wheels 56, 57 to follow the counts of the master decades 102, 103 respectively.

In the first stage slave circuit 110 (which, as described, provides for indexing the lowest order decade wheels 56 asynchronously relative to the master decade 102 if the master decade counting rate is greater than fifteen counts per second), a clocked binary count control latch 144 is connected to be set by the comparator 142 when the master and slave decade counts do not compare. A reset hold signal applied to the stepping counter 120 and to a clocked binary frequency control latch 146 is thereby removed to permit the counter 120 to be stepped either at a rate of 180 Hz (via an AND control gate 150) or at a rate of 90 Hz (via an AND control gate 152).

The frequency control latch 146 and count control latch 144 are clocked (via an inverter 154 and single-shot 155) at the twelfth or last step of each count cycle to establish if the counter 120 is to be immediately stepped without interruption through a succeeding count cycle, in which event the counter 120 is stepped (via the AND gate 150) at the relatively high frequency of 180 Hz (in the first stage slave circuit 110 and 200 Hz in the second stage slave circuit 112). It can be seen that the first-stage stepping counter 120 is stepped at the relatively low 90 Hz frequency (via the AND gate 152) through the first count cycle of each fuel delivery and also periodically during a relatively slow delivery when the master decade 102 is indexed at a rate of less than fifteen counts per second. Accordingly, the lowest order counter wheels 56 are always initially indexed from a rest position at one-half the normal operating frequency for accelerating the wheels 56 smoothly and with greater torque and to thereby reduce any possibility of miscounting.

Also, a count predictive circuit 160 comprising a latch 162 and a timing control latch 164 are provided in the first-stage slave circuit 110 for avoiding any visible wheel pause if a compare signal is momentarily generated when the master decade 102 laps and momentarily corresponds to the slave decade 138 at the twelfth step of the stepping counter 120. For that purpose, the timing control latch 164 is connected to permit the latch 162 to be set by an input count pulse to the master decade 102 which occurs between the first and twelfth steps of a count cycle of the stepping counter 120. If the latch 162 is set, the count control latch 144 is set at the twelfth step of the count cycle to step the counter 120 through a succeeding count cycle at 180 Hz. Therefore, the lowest order counter wheels 56 will be continuously stepped at the maximum rate of fifteen counts per second until the master decade 102 is indexed at a rate less than fifteen counts per second, whereupon the right hand counter wheels 56 will be indexed to catch and then track the master decade 102.

The second stage slave circuit 112 operates in general like the first stage circuit 110 to index the respective counter wheels 57, excepting that as previously indicated, the second counter wheels 57 are indexed to substantially track the second stage master decade 103. Thus, the count control latch 144 of the second stage slave circuit 112 is reset during the twelfth step of each count cycle of the counter 120 to condition the counter for receiving a count pulse in the form of a noncompare signal from the comparator. However, it will be seen that the second-stage slave circuit 112 permits part-time asynchronous operation of the counter wheels 57 (with the wheels 57 being up to a maximum of nine counts behind the master decade 103) without count loss. Also, the frequency control latch 146 in the second stage slave circuit 112 is connected for stepping the counter 120 at either 200 Hz or 100 Hz and at the relatively low rate of 100 Hz for accelerating the counter wheels 57 from rest and for indexing the counter wheels 57 from "9" (i.e., when the slave decade 138 has a 9 binary count) to "0". Accordingly, the counter wheels 57 are indexed at one-half the normal or maximum rate during the "9" to "0" count transfer interval during which one or both of the higher order counter wheels 58, 59 are indexed one count via the transfer pinions 54.

A price decimal point selector switch 180 may be provided as shown in FIG. 3A for selectively bypassing the divide-by-ten counter 105 and for thereby multiplying the unit volume price by a factor of ten. Thus, for example, if the variator 19 is set at a three-place unit volume price of 56-9/10, the established unit volume price would be $0.569 per unit volume (e.g., gallon) when the divide-by-ten counter 105 is connected in series with the first-stage master decade 102 as shown in FIG. 3A and $5.69 per unit volume when the divide-by-ten counter 105 is bypassed. Thus, when the counter 105 is bypassed, any three-place unit volume price up to $9.99 can be established in one-cent increments. Also, if the unit volume price is expected to be greater than, for example, $5.00, an asynchronous slave circuit like the first stage slave circuit 110 is preferably employed instead of the tracking slave circuit 112 for operating the second counter wheels 57 and a third-stage stepping motor system (not shown) like the second-stage stepping motor system described is employed in place of the transfer pinions 54 between the wheels 57, 58 for indexing the third-stage counter wheels 58 (and for indexing the fourth-stage counter wheels 59 via their transfer pinions 54).

In addition, it may be desirable to further modify the standard register as shown in part in broken lines in FIG. 3A, to employ a volume pulse generator 200 like the cost pulse generator 69 but connected, for example, to the horizontal volume shaft 34 to generate a volume pulse train with a pulse for each predetermined volume increment of fuel delivered. For example, as shown in FIG. 3A, the volume pulse generator is connected to generate a train of 450 pulses for each unit volume (e.g., gallon) on which the unit volume price of the fuel is based. The modified circuit shown provides for adding cost pulses (i.e., one-half cent cost pulses) via a switch 202 and an OR gate 204 to the input of the divide-by-two counter 104 when the price decimal switch 180 is switched to bypass the divide-by-ten counter 105. The half-cent pulses are generated at a rate which provides for adding $0.009 (9/10th of a cent) for each unit volume (e.g., gallon) which is dispensed when the high price range is selected with the price decimal switch 180.

Also, with the modified input circuit shown in broken lines in FIG. 3A, the cost pulse generator 69 is connected via a pulse sequence control circuit 208 and the OR gate 204 to the divide-by-two counter 104 as shown in broken lines, rather than directly to the counter 104 as shown by a solid line in FIG. 3A. A similar pulse sequence control circuit 210 is provided for the pulse train from the volume pulse generator 200, and the two control circuits 208, 210 are alternately operated by a 720 Hz clock for feeding the two pulses trains to the OR gate 204.

A modified counting system 300 (with modifications shown in part in FIG. 4 and in part in broken lines in FIGS. 3A and 3B) may be employed with a hundred count or increment right hand wheel that is substantially identical to the right hand wheel 56 excepting that its wheel rim would bear suitable indicia for one-hundred equally spaced (i.e., 3.6° spaced) increments of the wheel for registering a cost of from 0° to 99° cents. Also, the first-stage stepping motor 80 is geared to the hundred-increment wheels to index the wheels one increment or one cent for each step of the motor 80. Accordingly, the modified counting system 300 provides for stepping the motor 80 one step for each count of the right hand wheel (instead of through three full four-step cycles as previously described).

Figure 4:
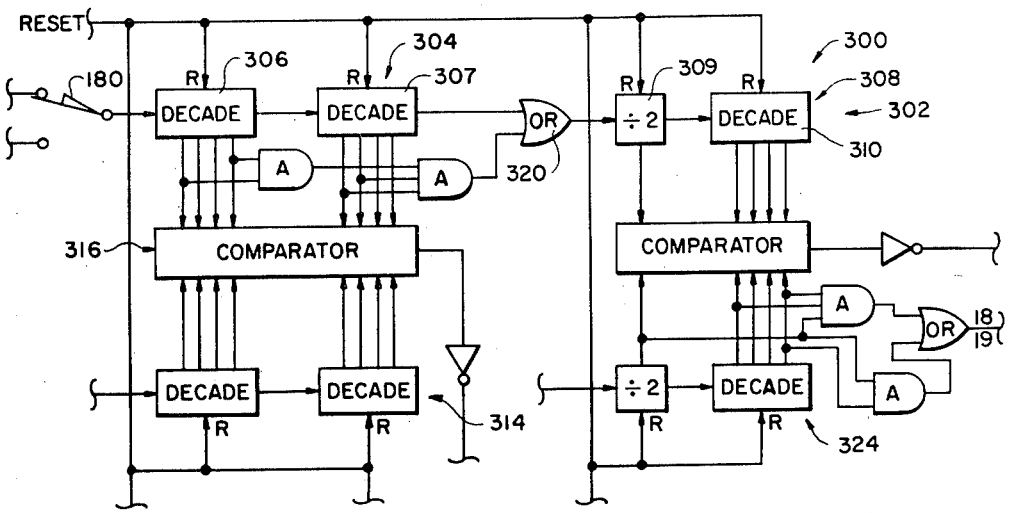
FIG. 4 is a generally schematic illustration, partly broken away, showing a further modification of the full line embodiment of the motor operating circuit of FIGS. 3A and 3B.

Referring to FIG. 4, the modified counting system 300 employs a modified master counter 302 with a first-stage master hundred counter 304 (with series connected binary decade counters 306, 307) and a second-stage master twenty counter 308 (with series connected two-count and decade counters 309, 310). A first-stage slave hundred counter 314 similar to the master hundred counter 304 and a suitable comparator 316 are employed for setting the count control latch 144 when the master and slave counters 302, 314 do not compare. Also, referring to FIG. 3A, a four count counter 318, connected to be indexed one count for each twelve-step cycle of the stepping counter 120, provides the binary input to the decoder 121 (instead of the counter 120) for indexing the motor 80 one step or phase for each cycle of the stepping counter 120. The slave counter 314 is indexed one count for each cycle of the counter 120 to remain in synchronism with the hundred-increment lowest order counter wheels. The counter 120 is preferably selectively stepped to provide a maximum wheel counting speed, for example, of 150 counts per second, in which case the counter 120 is stepped at 1800 Hz via the AND gate 150 and at 900 Hz via the AND gate 152.

Also, referring to FIG. 3B, the modified counting system 300 provides for indexing the second-stage motor 82 in six-step, one-half-count cycles to provide one-half-count transfers to the wheels 57 for avoiding ambiguous counter readouts as the lowest order wheels are stepped from "95" to "00". For that purpose, as functionally shown in FIG. 4, one-half-count transfer pulses are transmitted from the first-stage hundred master counter 304 via an OR gate 320 to the second stage master twenty counter 308 at the "95" and "00" counts of the first stage master counter 304.

A second-stage slave twenty counter 324 and a suitable comparator 326 are provided for selectively setting the second-stage count control latch 144 when the master and slave counters 308, 324 do not compare. Also, referring to FIG. 3B, a four count counter 328 is connected to be stepped six times for indexing the wheels 57 six steps or one-half count for each cycle of the stepping counter 120. For that purpose, the counter 120 is connected to have a six-step cycle rather than a twelve-step cycle as previously described. Also, an AND gate 332 is employed for indexing the slave counter 324 at the fifth step of the counter 120 and for clocking the latches 144, 146 at the sixth step of the counter 120.

The described fuel pump register modifications are therefore useful in the conversion of standard fuel pump register drive systems for increasing the useful life of the fuel pump register and its associated equipment. Such a modified fuel pump register could incorporate a substitute volume counting system like the substitute cost counting system described. In addition, it is contemplated that the variator could be replaced by a volume pulse generator (connected, for example, to be driven directly by the meter 16 or by the horizontal volume shaft 34) and a suitable presettable electronic cost computer (for example, of the type described in U.S. Pat. No. 3,696,236 of Crawford M. Kus. dated Oct. 3, 1972 and entitled "Computing Device") operable by the volume pulses from the volume pulse generator to generate cost pulses for stepping the first-stage master counter 101 or master counter 304 as the case may be, to accurately accumulate the cost amount of fuel delivered in accordance with a unit volume price established by the setting of the electronic cost computer. In that event, the single volume pulse generator would provide the volume pulse input to the electronic cost computer and if a volume counting system is also provided, the volume pulse input to the motor operating circuit of the volume counter section. Alternatively, the volume counters 24 could be mechanically driven by the meter 16 as described (even though a variator 19 is not provided).

Referring to FIGS. 6–12, there is shown a modified gasoline dispensing pump 404 having a fuel pump register 406 (which may be substantially identical to the described register 12 excepting as described hereinafter) and a substitute register drive unit 400 in place of the usual variator. The substitute register drive unit 400 has a suitable explosion-proof housing 408 mounted directly below the register 406. A vertical drive shaft 410 is rotatably mounted to extend centrally through the explosion-proof housing 408 for connecting a fuel meter 17 for driving the two opposed volume counters 24 of the register 406 substantially in the same manner as the variator center shaft 18 described with reference to FIG. 1. Also, preferably the explosion-proof housing 408 has a vertical dimension substantially the same as the conventional variator, has a width and depth no greater than the conventional variator, and is formed with the usual upper and lower variator mounting bosses or lugs (not shown) so that the register drive unit 400 is directly physically interchangeable with the conventional variator, thereby simplifying substitution of the register drive unit 400 for the variator in factory and/or field conversion of existing fuel pumps and use of the register drive unit 400 in new fuel pumps.

The explosion-proof housing 408 provides a housing for the electrical components of the register system without affecting the operative physical dimensions of the hardware package, previously comprising a register and variator assembly, and in accordance with the embodiment of the present invention shown in FIGS. 6–12, comprising an assembly of the register 406 and the register drive unit 400.

Two rotary stepping motors 412, 414 (like the rotary stepping motors 80, 82 previously described except they do not have explosion-proof housings) are mounted within upstanding, annular heat transmission collars 415, 416 respectively integrally formed with the housing 408. The motors 412, 414 are mounted with their vertical or upright output shafts 417 connected via suitable compliant or resilient drive couplings 418 to intermediate vertical drive shafts 419 rotatably mounted on and extending through the top 420 of the housing 408. The two intermediate drive shafts 419 are coupled via suitable quick disconnect universal couplins 421 (permitting slight lateral and angular misalignment of the shafts) to respective vertical drive shafts 422, 423 rotatably mounted within the register 406. The vertical drive shafts 422, 423 are mechanically connected through respective helical gearing 424 for driving the right hand or lowest order cost wheels 56 and the second order cost wheels 57 respectively. More particularly, referring to FIG. 7, the first wheel vertical drive shaft 422 is connected via helical gearing 424 to rotate the horizontal center shaft 85 and thereby rotate the right hand wheels 56 of the cost counters 44 in substantially the same manner as described with respect to the stepping motor 80. Similarly, the second wheel vertical drive shaft 423 is connected via helical gearing 424 to rotate a rotatable sleeve 425 and thereby rotate the second order wheels 57 of the cost counters 44 in substantially the same manner as described with respect to the stepping motor 82.

Thus, the rotary stepping motor 412 is connected to step the two lowest order cost wheels 56 and the stepping motor 414 is connected to step the two second order cost wheels 57. The drive ratio of the helical gearing 424 in each drive train is established as desired, in the described embodiment to provide ten steps of each motor 412, 414 for each 36° step of the respective counter wheels (and therefore a 3.6° counter wheel step for each 7½° step of the respective stepping motor 412, 414).

A suitable flywheel 428 is mounted on each intermediate drive shaft 419 within the housing 408 for cooperation with the respective resilient drive coupling 418 for damping the rotary drive from the stepping motor to the counter wheels and thereby increase the useful life of the drive train and reduce the drive train noise.

The register drive unit 400 comprises two oppositely facing master and slave banks 430, 431 of four aligned rotary price wheels 432, 433 and 434 respectively for posting the established unit volume price of fuel within a four place decimal price range, for example, within a price range of $0.000 to $9.999.

The two opposed price wheel banks 430, 431 are mounted on opposite ends of the register drive unit 400 below the oppositely facing register volume and cost counters for posting the established unit volume price in substantially the same location as the conventional variator. Each master price wheel 432, 433 has an enlarged thumb wheel 435 for manually setting the price wheel at any one of its 0–9 positions. A depending pin 436, 437 of each master price wheel 432, 433 is adapted to engage a stop 438 to establish "0" and "9" opposite angular limit positions of the price wheel.

The slave price wheels 434 at the opposite end of the register drive unit 400 are mechanically connected to the respective master price wheels 432, 433 by price wheel drive gears 439 and respective rotatable gear sector levers 440–443 rotatable on the housing 408 coaxially with the center shaft 410. Also, each master price wheel 432, 433 is connected for operating a respective ten position rotary switch 444 (FIG. 6) mounted within the housing 408 by gears 446, 447 and a rotatable switch operating shaft 448 extending through the top 420 of the housing 408.

Therefore, the four price switches 444 are positively mechanically connected to the banks 430, 431 of master and slave price wheels to provide respective order electrical signals of the established unit volume price of fuel displayed at both ends of the register 406 by the two banks of master and slave price wheels.

A rotary electrical pulse generator 452 is mounted within the housing 408 for being driven via gears 453, 454 by the vertical drive shaft 410. The pulse generator 452 may be substantially identical to the pulse generator 69 described with reference to the embodiment of FIGS. 1–5 excepting the pulse generator 452 does not have a separate explosion-proof housing. Thus, as in the embodiment of FIGS. 1–5, the pulse generator 452 is connected to generate a train of volume pulses with a pulse for each predetermined angular increment of rotation of the center shaft 410, and preferably in the described embodiment 125 pulses for each revolution of the center shaft 410, whereas in the conventional register drive system, the register drive shaft is rotated four revolutions for each unit volume on which the unit volume price is based.

The explosion-proof housing 408 has a threaded opening 458 for connecting a suitable explosion-proof electrical conduit 460 (FIG. 6) provided for supplying electrical power to the electrical components contained within the housing 408. Also, if desired, the system may be designed for remote preset and remote readout of the cost and volume of fuel delivered, in which event, electrical leads would also be provided in conduit 460 for connecting remote volume and/or cost preset switches 462 (FIG. 12) to the register drive unit 400 and for connecting the register drive unit 400 to a remote cost and/or volume readout register 464 (FIG. 12) and for controlling the usual solenoid operated two-stage fuel shut-off valve (not shown) conventionally provided in preset systems.

Figure 11:
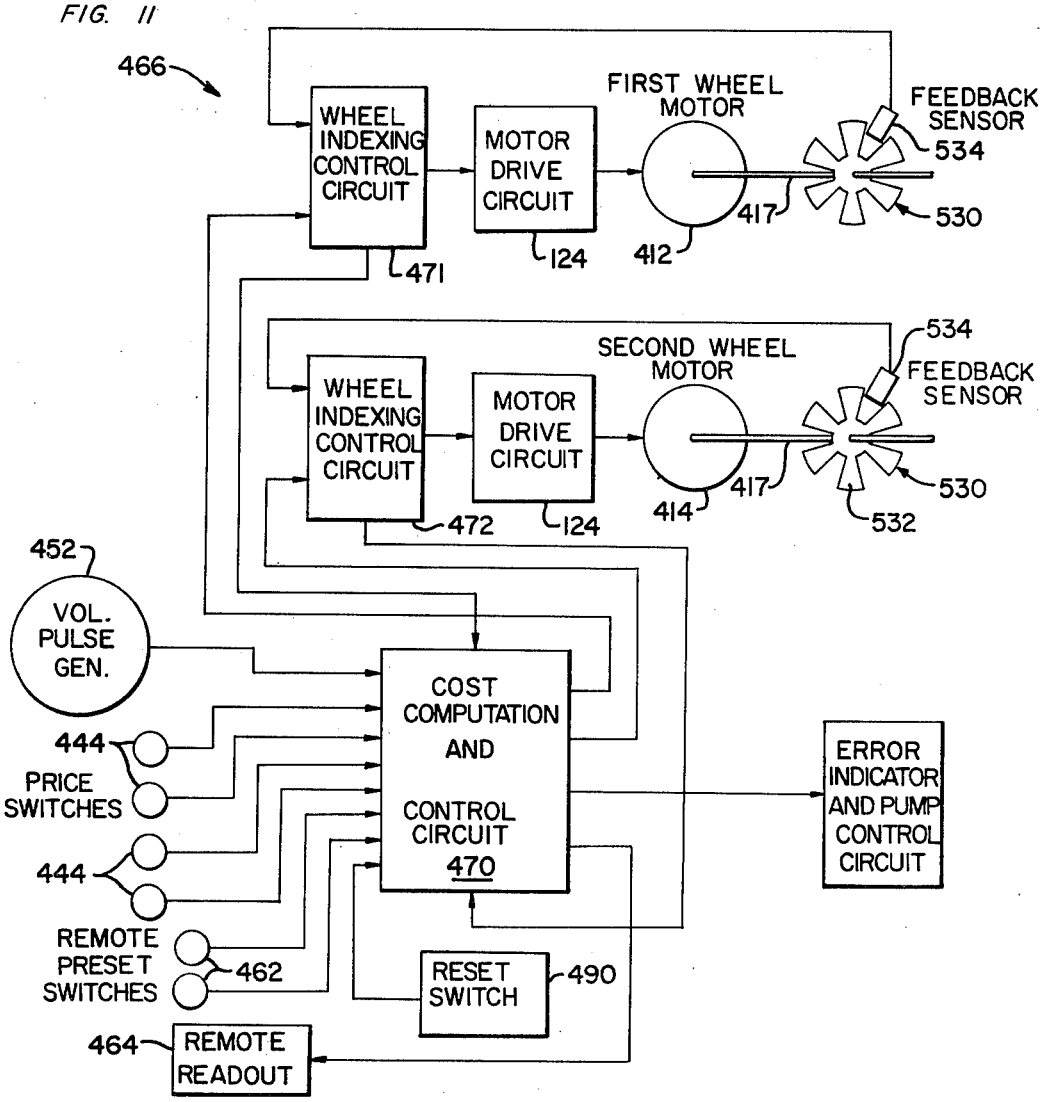
FIG. 11 is a generally schematic illustration, partly broken away, of a motor operating system of the counter operating system of FIG. 6.

Referring to FIG. 11, an operating circuit 466 of the register drive unit 400 (mounted in the housing 408) comprises three suitable microprocessors 470–472. One microprocessor 470 is employed as a controller for controlling the register system and for computing the cost amount of fuel dispensed in accordance with the number of volume pulses received from the volume pulse generator 452 and the multiple place unit volume price established by the bank of four price switches 444. A second microprocessor 471 is provided for operating the first or lowest order counter wheel stepping motor 412, and a third microprocessor 472 is provided for operating the second wheel stepping motor 414. The computation and control microprocessor 470 transmits an appropriate train of cost pulses to each wheel microprocessor 471, 472 having a cost pulse for each step of the respective indexing motor 412, 414. As hereinafter more fully described, each microprocessor 471, 472 operates the respective four phase stepping motor 412, 414 via a motor drive circuit 124 to step the respective counter wheels 56, 57 in accordance with the number of pulses and frequency of the respective cost pulse train.

Figure 8:
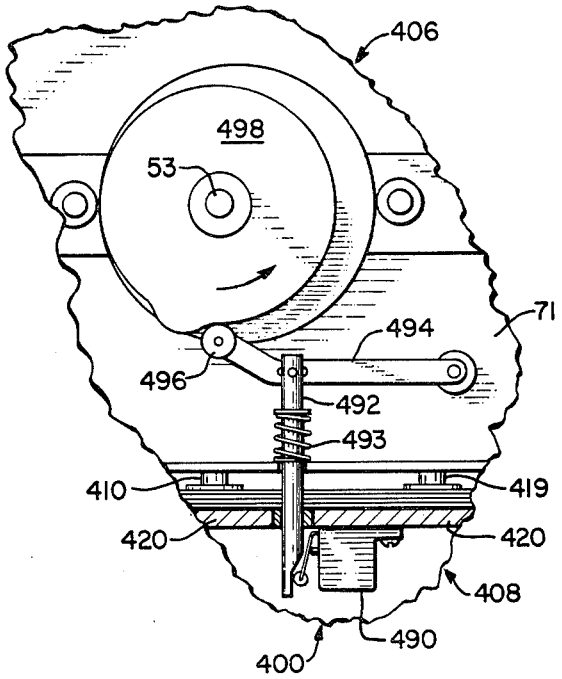
FIGS. 8 and 9 are partial enlarged side elevation views, partly broken away and partly in section, of opposite sides of a register and register drive unit assembly of the gasoline dispensing pump of FIG. 6.

Referring to FIG. 8, a reset switch 490 is mounted within the housing 408 for actuation by a vertical rod 492 extending through and axially shiftable within the top 420 of the housing 408. The rod 492 is biased upwardly by a spring 493 and is connected to a lever 494 having a follower 496 engageable with a auxiliary cam 498 mounted on the end of the center shaft 53 of the register 406. The cam 498 is contoured to actuate the reset switch 490 to transmit a reset signal to the computation and control microprocessor 470 at the beginning of each register reset cycle (during which the register reset shaft 53 is rotated one revolution in a conventional manner) for resetting the operating circuit 466.

Figure 7:
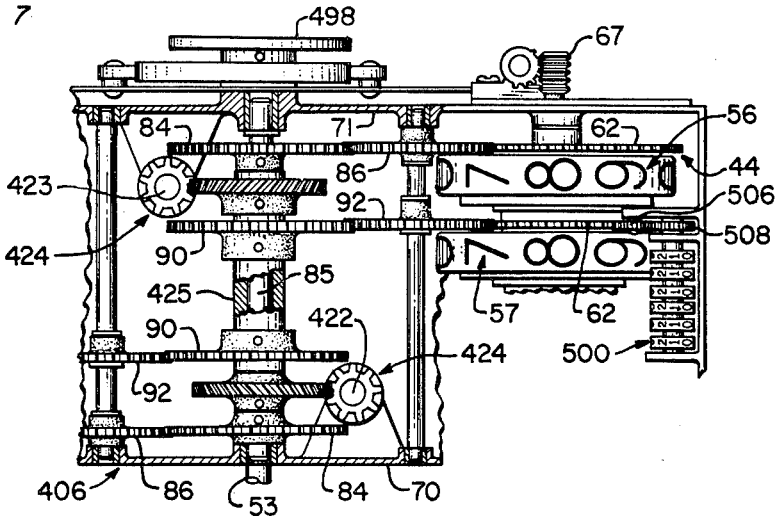
FIG. 7 is a partial top plan view, partly broken away and partly in section, of a register of the gasoline dispensing pump of FIG. 6.

Referring to FIG. 7, the register 406 is modified so that its usual nonresettable cost totalizer 500 (provided for registering the total cost of fuel delivered to the nearest cent) is connected to be driven by the second wheel stepping motor 414 via the second wheel drive gear 62, an idler gear 506 and a totalizer drive gear 508. The totalizer 500 is driven by the second wheel stepping motor 414 instead of the first wheel stepping motor 412 since the first wheel stepping motor 412 is adapted to be operated in a slew mode and whereby the total rotation of the right hand money wheels 56 during a gasoline delivery is not necessarily equal to the total cost of fuel delivered.

As previously described with respect to the embodiment of FIGS. 1–5, the second cost wheels 57 are digitally indexed as fuel is delivered to indicate a whole number decimal cost count, such as the whole number of dimes or dollars depending on whether the right hand wheels 56 have ten or one hundred penny ($0.01) divisions. Therefore, at the end of a fuel delivery, if the right hand wheel count is other than zero, the cost totalizer 500 will have been indexed less than the total actual cost count by an amount equal to the final decimal count of the right hand wheels 56.

During reset, all of the counter wheels 56–59 of the cost and volume counters 24, 44 are disconnected from their drive gears 62, 64, are reset to zero, and are then reconnected to their drive gears 62, 64 for conditioning the register 406 for the succeeding delivery. In order to prevent a cummulative totalizer error of the final counts of the lowest order wheels 56, during wheel reset and before the volume and cost counter wheels are reconnected to their drive gears 62, 64, the second wheel motor 414 is operated by its respective microprocessor 472 (when the reset switch 490 is actuated), to index the totalizer 500 the appropriate number of steps to include the final decimal count of the right hand wheels 56. Thus, for example if the right hand wheels 56 were at "5" at the end of the prior delivery, during reset the second wheel motor 414 would be indexed five steps to update the totalizer 500 and thereby remove the end-of-delivery totalizer error.

Figure 9:
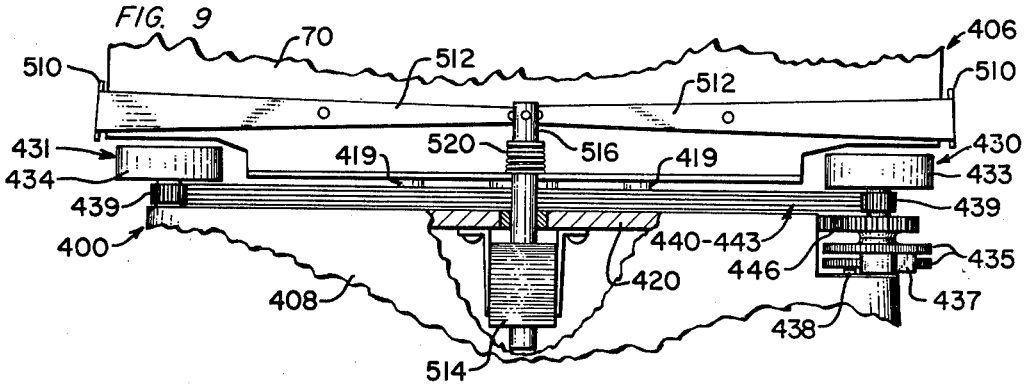
Figure 12:
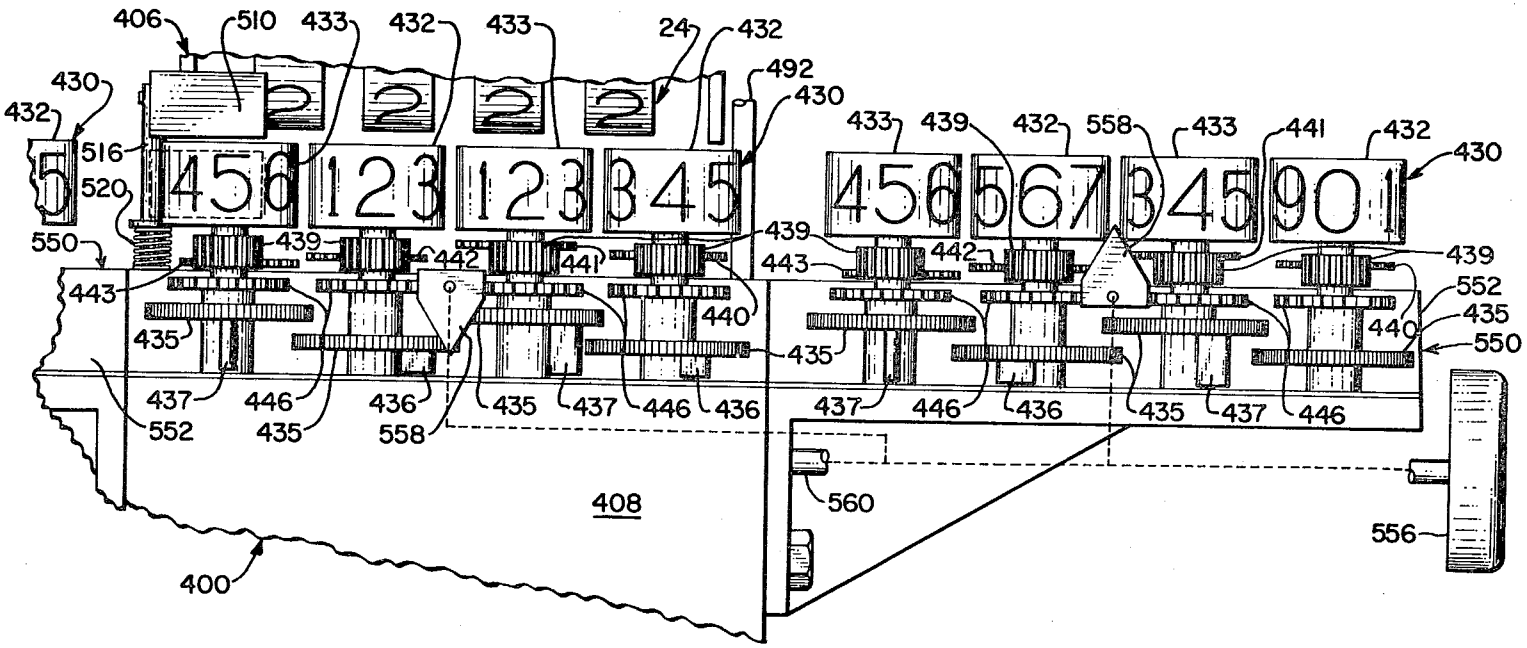
FIG. 12 is a reduced partial front elevational view, partly broken away and partly in section, showing a modified register and register drive unit assembly useful with a three product gasoline dispensing pump.

Referring to FIGS. 9 and 12, error signal flags 510 are provided at opposite ends of the register 406 for signalling improper operation of the cost counter operating system of the register drive unit 400. In the shown embodiment, the signal flags 510 are provided by inturned ends of levers 512 pivotally mounted on the side 70 of the register frame. The lever flags 510 are held in their upper withdrawn positions by a solenoid 514 mounted within the explosion-proof housing 408 and connected to the inner ends of the levers 512 through a vertical, axially shiftable rod 516 extending through the top 420 of the housing 408. If the solenoid 514 is deenergized (for example, due to loss of power, an electrical circuit failure or improper setting of one of the rotary price switches 444 in an ambiguous angular position between price settings), a spring 520 biases the rod 516 upwardly to lower the flags 510 into view and thereby signal faulty operation of the register cost counters 44. For that purpose, the microprocessor 470 is employed for verifying correct operation of the electrical system and that each price switch 444 is in an unambiguous price position, and the individual wheel microprocessors 471, 472 are employed in combination with respective motor feedback photo sensors 530 for verifying that the motors 412, 414 are functioning properly.

Figure 10:
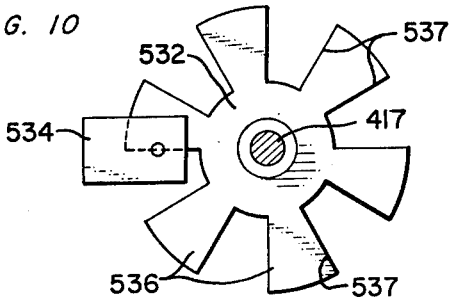
FIG. 10 is an enlarged top plan view of a photoelectric pulse generator of the counter operating system of FIG. 6.

Each feedback sensor 530 comprises a shutter wheel 532 mounted on the respective motor shaft 417 and a suitable photoelectric pickup 534. Referring to FIG. 10, the shutter wheel 532 comprises six equiangularly spaced, 30° wide segments 536 and six intermediate, equiangularly spaced, 30° wide slots 537. Thus, each stepping motor 412, 414 is stepped four times or through one full, four-phase motor cycle for rotating each segment 536 and each slot 537 by the pick up 534. The photoelectric pickup 534 is timely interrogated or checked via the respective microprocessor 471, 472 after each 7½° motor step, and whereby on average and under ideal conditions, each microprocessor 471, 472 would each read four successive slot or light transmitting states followed by four successive segment or light blocking states, etc. as the respective stepping motor 412, 414 is indexed. However, due to motor oscillation, ambiguous sensing at the slot edges, inertial effects of the drive trains, etc., it has been found that under actual operating conditions, two, three, four, five, or six successive identical states can be read without the presence of system error. Thus, if two to six successive slot states are read, the respective motor drive microprocessor 471, 472 (hereinafter called MDM for simplicity) does not generate an error signal for deenergizing the flag control solenoid 514. The same is true for segments. However, each MDM 471, 472 is programmed to generate an error signal for deenergizing the flag solenoid 514 if seven or more successive slot or segment states are read or if a single slot or segment state is followed by the alternate state.

Also, an error signal control register provided in each MDM 471, 472 is indexed one count in the additive direction each time a slot/segment state reversal is read by the respective feedback sensor 530. The register is also indexed one count in the subtractive direction for each cycle of four steps of the respective motor 412, 414. If the register count remains within the range of −1, 0, or +1, the motor is considered to be operating properly. Any other register count is considered to result from a motor operating error, and the respective MDM 471, 472 signals the computation and control microprocessor 470 to deenergize the error indicator solenoid 514.

When a cost pulse is transmitted to each MDM 471, 472 from the computation and control microprocessor 470, the MDM operates the appropriate succeeding stepping motor phase to index the motor 412, 414 one step. If several cost pulses are transmitted to an MDM in quick succession, the MDM 471, 472 controls the rate at which the stepping motor 412, 414 phase is indexed, gradually increasing the stepping rate to the appropriate level. This allows each stepping motor 412, 414 to gradually accelerate the wheels 56, 57 so that the inertia reaction load on the motor 412, 414 is maintained at an acceptable level. Likewise, if the cost pulses transmitted to the MDM 471, 472 suddenly stop, the MDM 471, 472 gradually decreases the stepping rate of the motor to limit the deceleration load to an acceptable level. Thus, in order to ensure that the MDM 471, 472 does not overshoot the desired count position during deceleration, during wheel rotation, the MDM 471, 472 operates the respective wheel indexing motor 412, 414 to maintain the respective wheels 56, 57 lagging behind the actual or true count position.

If the cost pulses received by MDM 471, 472 are spaced thirty-five milliseconds or more apart, the MDM steps the motor at the same rate as the input pulse rate. If the input pulse rate is higher, the MDM steps the motor at one of fifteen different pre-established rates, the specific rate being as close to the actual input pulse rate as possible. If the input pulse is between two possible output rates, the MDM steps the motor alternately at the two rates so that the resulting average motor stepping rate equals the average pulse input rate.

In accelerating or decelerating a motor 412, 414 to any particular stepping rate, the MDM steps the motor at least once at each succeeding rate until the appropriate motor stepping rate is reached. Thus, each motor is indexed from rest to its maximum stepping rate of 150 steps per second (corresponding to an input pulse spacing of 6.67 milliseconds) in at least 15 steps, with at least one step at each of the fifteen available successively faster stepping rates.

If the MDM 471 operating the right hand wheel motor 412 receives input pulses at a rate greater than 150 pulses per second, the MDM 471 accelerates the motor 412 to and operates the motor 412 in a slew mode at the maximum rate of 150 steps per second. Since input pulses are then being received at a rate faster than the motor 412 is being stepped, the position of the right hand wheels 56 will lag behind the corresponding actual or true cost count. When the wheel falls more than one hundred steps behind the corresponding actual cost count, the MDM 471 automatically subtracts one hundred steps from the actual cost count since it is not possible for the wheels 56 to be more than one revolution behind the corresponding actual cost count. At such time as the input count pulse rate drops below 150 pulses per second, the motor 412 continues to operate at its maximum stepping rate until the wheels 56 are fifteen steps behind the corresponding actual cost count whereupon they are decelerated to the actual input count pulse rate.

When decelerating the wheels, the MDM 471, 472 operates the respective stepping motor 412, 414 at least one step at each successively slower stepping rate until the motor stepping rate reaches the input pulse rate. Accordingly, the first wheel motor 412 is decelerated to a rest from its maximum speed of 150 steps per second, in fifteen motor steps with one motor step at each of the fifteen stepping rates. Thus, in order to prevent wheel overshoot beyond the actual count position, when operating the motor 412 at maximum speed, the MDM 471 operates the motor 412 so that the first order wheels 56 lag fifteen steps or 54° behind the actual count. Likewise, if either motor 471, 472 is operating, for example, at the ten rate level, the respective wheels 56, 57 are indexed to lag ten steps or 36° behind the actual count. And whenever the actual count of either MDM is ahead of the actual wheel position by a number of steps greater than the existing indexing rate level of the respective motor, the MDM operates the motor to step the wheel at the next higher rate level. This process continues until the wheel count lags the actual count by a number of steps equal to the wheel rate level or until the maximum stepping rate is reached.

Likewise, when the wheel count lags the actual count by a number of steps less than the existing rate level, the MDM 471, 472 causes the wheel to step at the next lower speed. This process also continues until the number of lag steps equals the rate level or until the wheel stops.

Thus, each wheel motor 412, 414 is automatically stepped by its respective MDM 471, 472 through fifteen different pre-established stepping rate levels in accordance with the corresponding decimal cost counting rate (which depends on the unit volume price established by the bank of price switched 444 and the volume rate of fuel delivered).

Referring to FIG. 12, the register drive unit 400 described may be employed in multiple product fuel pumps, (for example blending pumps employed for delivering three or more different grades of gasoline) by adding a suitable auxiliary price mechanism 550 for each additional fuel product. The shown auxiliary price mechanism 550 has an explosion-proof housing 552 and a bank 230 of master price indicators connected for setting respective price switches 444 (not shown) mounted within the housing 552 as in the register drive unit 400. Also, a bank 231 of slave price indicators (not shown) is mounted at the opposite end of the price mechanism and the individual decade indicators are connected by gear segment levers as in the register drive unit 400. Accordingly, each auxiliary price mechanism 550 provides for posting the desired pre-established multiple place price for the corresponding gasoline product at opposite ends of the register, preferably in alignment with the master and slave price indicators of the register drive unit 400.

The auxiliary price mechanism 550 may be physically attached to the register drive unit 400 for example as shown in FIG. 12 to provide an integral multiple product, register drive unit assembly. A rotary product selector knob 556 is shown provided for selecting each of the available products, and the selector knob 556 is therefore connected for operating the usual blend gearing (not shown) where the multiple product register drive unit assembly is employed in a fuel blending pump. Also, suitable rotary product indicators 558 are provided and connected to the selector knob 556 to designate the appropriate unit volume price of the selected fuel product. Further, the bank of price switches 444 of each auxiliary price mechanism 550 are connected to a suitable rotary price selector switch (not shown, but preferably mounted in the explosion-proof housing 408) and the product selector knob 556 is suitably connected (e.g., via a rotary shaft 560) to the price selector switch for transmitting the established unit volume price of the selected fuel product to the microprocessor 470 for use in computing the cost of the fuel delivered.

As will be apparent to persons skilled in the art, various modifications, adaptions and variations of the foregoing specific disclosure can be made without departing from the teachings of the present invention.

I claim:

1. A method of angularly indexing a rotary counting register having at least one rotary register wheel, at a variable register counting rate to register an incoming count having a variable incoming counting rate, with an electrical stepping motor electrically operable in individual steps at a variable stepping rate for indexing the rotary register at a variable register counting rate, the method of angularly indexing the rotary register comprising the steps of accumulating an incoming count at a variable incoming counting rate and electrically operating the stepping motor at a variable stepping rate so that the registered count of the rotary register lags said accumulated count by a variable plurality of individual steps of the motor which varies generally proportionally with one of said variable rates.

2. A method of angularly indexing a rotary counting register according to claim 1 wherein the register counting rate is varied substantially by operating the stepping motor through a succession of different intermediate stepping rates with the motor being stepped at least once at each of said intermediate stepping rates.

3. A method of angularly indexing a rotary counting register having at least one rotary register wheel, at a variable register counting rate to register an incoming count having a variable incoming counting rate, with an electrical stepping motor electrically operable in individual steps at a variable stepping rate for indexing the rotary register at a variable register counting rate, the method of angularly indexing the rotary register comprising the steps of accumulating an incoming count at a variable incoming counting rate and electrically operating the stepping motor at a variable stepping rate with substantial changes in the stepping rate being made by operating the stepping motor through a succession of different intermediate stepping rates with the motor being stepped at least once at each of said intermediate stepping rates.

4. A method of angularly indexing a rotary register wheel at a variable register counting rate to register an incoming count having a variable incoming counting rate, with an electrical stepping motor operable for indexing the rotary register wheel at a variable register counting rate and electrically operable in individual steps at each of a plurality of different pre-established stepping rates, including minimum and maximum stepping rates and a plurality of intermediate stepping rates, the method of angularly indexing the rotary register wheel comprising the steps of accumulating an incoming count at a variable incoming counting rate and electrically operating the stepping motor at said pre-established stepping rates so that the registered count of the rotary register wheel lags said accumulated count by a variable number of individual steps of the motor which varies generally proportionally with one of said variable rates.

5. A method of angularly indexing a rotary register wheel according to claim 4 further comprising electrically operating the stepping motor in a slew mode at said maximum stepping rate when the actual incoming counting rate is greater than an incoming counting rate which corresponds to the maximum stepping rate and, when the actual incoming counting rate is less than said corresponding incoming counting rate, electrically operating the stepping motor at least once at each successively lower stepping rate until the rotary register wheel lags said accumulated count by a variable number of individual steps of the motor which varies generally proportionally with said one variable rate.

* * * * *